US005922982A

United States Patent [19]

Ishibashi

[11] Patent Number: 5,922,982

[45] Date of Patent: Jul. 13, 1999

[54] PERFORMANCE DATA GENERATION APPARATUS FOR SELECTIVELY OUTPUTTING NOTE ON/OFF DATA BASED ON PERFORMANCE OPERATION MODE

[75] Inventor: Susumu Ishibashi, Shizuoka-ken, Japan

[73] Assignee: Yamaha Corporation, Hamamatsu, Japan

[21] Appl. No.: 08/844,705

[22] Filed: Apr. 18, 1997

[30] Foreign Application Priority Data

Apr. 19, 1996 [JP] Japan ..... 8-120821

[51] Int. Cl.[6] ..... G10H 1/02; G10H 1/18

[52] U.S. Cl. ..... 84/615; 84/626; 84/737; 84/742

[58] Field of Search ..... 84/615–620, 653–658, 84/742, 622–633, 659–665, 735–741

[56] References Cited

U.S. PATENT DOCUMENTS

| | | | |
|---|---|---|---|
| 4,702,141 | 10/1987 | Bonanno . | |
| 4,730,530 | 3/1988 | Bonanno . | |
| 4,915,008 | 4/1990 | Sakashita | 84/658 |
| 4,947,726 | 8/1990 | Takabayashi . | |
| 5,010,800 | 4/1991 | Yoshida | 84/742 X |
| 5,206,446 | 4/1993 | Matsumoto et al. | 84/615 X |
| 5,276,273 | 1/1994 | Takauji | 84/615 |
| 5,361,673 | 11/1994 | Kira et al. | 84/615 |

*Primary Examiner*—Stanley J. Witkowski
*Attorney, Agent, or Firm*—Pillsbury Madison & Sutro LLP

[57] ABSTRACT

A performance data generation apparatus generates performance data for controlling the tone generation condition of a tone to be generated based on a string vibration signal obtained from the string vibration of a stringed instrument. The performance data generation apparatus includes an operation member for selecting a predetermined performance operation mode and a control device responsive to the operation member. When the predetermined performance operation mode is selected by operating the operation member, the control device does not output note-on data or note-off data among performance data that is generated based on the string vibration signal, and outputs specified performance data other than the note-on data and the note-off data.

21 Claims, 11 Drawing Sheets

PERFORMANCE DATA GENERATION APPARATUS FOR SELECTIVELY OUTPUTTING NOTE ON/OFF DATA BASED ON PERFORMANCE OPERATION MODE

BACKGROUND OF THE INVENTION

1. Field of the Invention

Embodiments of the present invention relate to a performance data generation apparatus, and more particularly to a performance data generation apparatus including a guitar synthesizer that generates performance data, such as MIDI (music instrument digital interface) signals based on performance signals provided by a stringed instrument or the like.

2. Description of Related Art

A conventional guitar synthesizer detects string vibrations of a stringed instrument, such as a guitar, and generates performance data representative of string vibration signals based on the detected string vibrations. MIDI signals are generated based on the performance data, and used to drive a sound source apparatus. The sound source apparatus generates tones having tone colors, pitches and tonal strength (velocity) based on the performance.

As a typical acoustic characteristic of a guitar which is a plucked instrument, a tone (or a string vibration) that is generated upon playing the guitar string has an envelope that rapidly rises and attenuates. As a result, the time duration of a tone that is generated by the guitar is relatively short.

In order to generate a tone that lasts for an extended period of time with a guitar, a guitar synthesizer is provided with a performance mode that uses a sustain pedal or a hold pedal. Generally, the sustain pedal or the hold pedal is provided as a pedal switch that is connected to the guitar synthesizer and is operated by the performer's foot.

FIGS. 10 (*a*) and 10 (*b*) show an example of a conventional performance method in which a sustain pedal is used. More specifically, FIG. 10 (*a*) schematically shows envelopes of string vibrations representative of performance notes that are played by a performer (herein after referred to as notes). FIG. 10 (*b*) schematically shows envelopes of sound source output notes having a predetermined tone color. The sound source output notes are generated based on performance data representative of the string vibrations shown in FIG. 10 (*a*) and outputted by a sound source apparatus of a guitar synthesizer.

For example, as shown in FIG. 10 (*a*), when the performer plays a note A at time t1, the guitar synthesizer generates a corresponding MIDI signal of note-on data. As shown in FIG. 10 (*b*), a sound source output note As is generated by the sound source apparatus at a time corresponding to time t1. The sound source output note As has a pitch and a velocity corresponding to those of the note A.

In this case, the performer operates the sustain pedal at time t2 while the note A is still in a note-on state, as shown in FIG. 10 (*a*). In response to the operation of the sustain pedal, the guitar synthesizer starts a sustain mode at time t2.

For example, when the sustain mode is started, a sound source output note that is generated by the sound source apparatus is controlled so that the sound source output note is gradually attenuated at a specified sustain rate that is pre-set for the tone color of the sound source output note. In other words, even when vibration of the note A shown in FIG. 10 (*a*) substantially stops at time t3, and accordingly note-off data for the note A is generated, the guitar synthesizer invalidates the note-off data and the sound source output note As is sustained at the sustain rate so that the tone generation of the sound source output note As is continued. As a result, even when a note originally played by the guitar attenuates to zero level, the sound source output note is continuously generated by the sound source apparatus for an extended period of time, substantially longer than the note originally generated by the guitar.

In this example, the performer plays a note B at time t4 as shown in FIG. 10 (*a*). The guitar synthesizer generates a sound source output note Bs by the sound source apparatus having the same tone color of the sound source output note As based on note-on data representative of the note B, using a tone generation channel which is different from the one used for the sound source output note As. In this example, the sustain mode is maintained to be turned on even after the note B is played. As a result, note-off data for the note B is likewise invalidated when the note B completely attenuates at time t5. As a consequence, in addition to the sound source output note As which has been previously generated and is sustained, the sound source output note Bs is also sustained at a predetermined sustain rate. Accordingly, after time t4, the sound source output notes As and Bs are concurrently outputted until the sound source output note As completely attenuates.

By using the above-described operation, a note A and a note B having different pitches may be played concurrently to form a chord that lasts for a substantially extended period of time which may be impossible to attain by an ordinary guitar performance. Also, an ordinary guitar has six strings and therefore a chord containing more than six notes cannot be performed by an ordinary performance method. However, the sustain mode allows many more notes to be successively superposed. As a result, a chord containing seven or more notes can be readily formed, depending on the number of tone generation channels.

FIGS. 11 (*a*) and 11 (*b*) show an example of a conventional performance method in which a hold pedal is used. More specifically, FIG. 11 (*a*) schematically shows string vibrations representative of notes played by the guitar, and FIG. 11 (*b*) schematically shows envelopes of sound source output notes that are outputted from the sound source apparatus of the guitar synthesizer according to MIDI signals which are generated based on the string vibrations.

For example, when a hold mode is started by the operation of the hold pedal, the tone generation is controlled so that note-off data for a note is invalidated and a sound source output note corresponding to the note is sustained, which is similar to the sustain mode described above. However, in the hold mode, the sustain operation is continued until the hold mode is canceled.

Further, in the hold mode, a sound source output note that is generated based on newly provided note-on data uses a MIDI channel that is different from a MIDI channel used by a sound source output note that has been previously generated.

More particularly, when a note A is played at time t1 shown in FIG. 11 (*a*) after the hold pedal is operated to start the hold mode, note-on data for the note A is provided. As a result, a sound source output note Ah representative of the note A is generated as shown in FIG. 11 (*b*). Since the sound source output note Ah is currently sustained in the hold mode, note-off data for the sound source output note Ah is ignored even when the note A attenuates, for example, at time t2. Then, a new note B is played at time t3, and a sound source output note Bh representative of the note B is generated.

As described above, the sound source output note Bh is generated using a MIDI channel that is different from the one used for the previously generated sound source output note Ah. Also, the sound source output notes are sustained until the hold mode is removed.

The performance in the hold mode provides a variety of acoustic effects. For example, a chord containing notes that last for an extended period of time is readily provided, which is similar to the acoustic effect provided by the sustain mode. Furthermore, different tone colors may be assigned to MIDI channels that are respectively used by the sound source output notes Ah and Bh. Consequently, a chord including different tone colors is obtained, resulting in an acoustic effect that assimilates a performance by a plurality of different pieces of musical instrument.

Now, let us consider one of the performance methods desired to be achieved by a guitar synthesizer in which one tone color is generated for an extended period of time by using a sustain mode or a hold mode, and pitch variation (pitch bend) is optionally added to the tone color that is sustained.

There are a variety of performance methods to add pitch variation to a note that is generated upon picking or strumming the guitar string, such as, for example, a slide performance method, a choking performance method, an arming performance method and the like. In the slide performance method, after a note is played by picking the guitar string, the performer slides the finger that depresses the guitar string from one fret to another with the string being continuously depressed by the finger. In the choking performance method, the guitar string that is depressed by the finger is pulled in a direction along the finger plate to change the tension of the guitar string to raise the pitch. Also, a vibrato unit is used to change the pitch of the guitar string in the arming performance method. The vibrato unit typically includes a bridge for supporting the guitar strings that is rotatable about a pivot, and an action member, known as an arm, for moving the bridge to thereby change the pitch of the guitar string. Tones of the guitar strings that are changed by one of the above-described methods are converted to MIDI pitch bend data by the guitar synthesizer to control pitches of sound source output notes.

However, the above-described performance methods and intended effects are very difficult to achieve when either the sustain mode or the hold mode described above with reference to FIGS. 10 (*a*) and 10 (*b*) or FIGS. 11 (*a*) and 11 (*b*), respectively, is used.

For example, in the case of the sustain mode, a note A is played at time t1 shown in FIG. 10 (*a*) to start a note-on state, and the sustain mode is started at time t2. As a result, as described above, a sound source output note As is generated and sustained at a specified sustain rate as shown in FIG. 10 (*b*). However, pitch bend control over the sound source output note As is only possible until the note A completedly attenuates, as shown in FIG. 10 (*c*). In other words, even though the performer adds pitch variation to the note A by using one of the performance methods described above, the pitch variation in the note A is reflected in the sound source output note As until time t3 when the note A attenuates and comes to a note-off state, as shown in FIG. 10 (*c*). Accordingly, during the period between t1 and t3, the note A or the pitch variation in the note A is detected and a MIDI signal for pitch bend data representative of the pitch variation in the note A is outputted, and therefore the pitch bend control over the sound source output note As can be performed. However, when the note A comes to a note-off state at time t3 and thereafter, pitch bend data for the note A is not provided. As a result, the pitch is fixed based on pitch bend data that is obtained immediately before time t3 and the sustain operation is continued, and therefore further pitch bend control over the sound source output note As cannot be performed beyond time t3.

Let us assume that the performer then plays a note B at time t4 by picking at the same string that generates the note A in an attempt to add pitch variation to the sound source output note As shown in FIG. 10 (*a*). By such a performance by the performer, a new sound source output note Bs is generated at a time corresponding to time t4, using a different tone generation channel, as described above. As a result, two of the notes are superposed with one another. It is noted that no pitch bend control over the sound source output note is available during the period between time t3 and time t4, as shown in FIG. 10 (*c*).

When the performer adds pitch variation to the note B in the state described above, pitch bend is added to both of the sound source output notes As and Bs because the sound source output notes As and Bs are generated by the same MIDI channel and therefore pitch bend data is effective to both of the sound source output notes As and Bs. In some cases, the sound source output notes As and Bs may form a dissonant chord that is not desired by the performer.

Therefore, in the sustain mode operation shown in FIGS. 10 (*a*) and 10 (*b*), the pitch bend control cannot be continuously performed on a sound source output note while the sound source output note is sustained. Also in the hold mode operation shown in FIGS. 11 (*a*) and 11 (*b*), the pitch bend control likewise cannot be continuously performed on a sound source output note that is placed in the hold mode.

SUMMARY OF THE INVENTION

It is an object of the present invention to provide a performance data generation apparatus that enables a new performance method by an electronic musical instrument, such as, for example, a guitar synthesizer.

In accordance with one embodiment of the present invention, a performance data generation apparatus sustains a sound source output note that is generated in response to a note played by a stringed instrument and provides pitch bend control over the sound source output note for an extended period of time even after the note fades away.

In accordance with another embodiment of the present invention, a performance data generation apparatus generates performance data for controlling tone generation condition of a tone to be generated based on a string vibration signal obtained from string vibration of a stringed instrument. The performance data generation apparatus includes an operation member for selecting a predetermined performance operation mode and a control device responsive to the operation member. In a preferred embodiment, the control device does not output note-on data or note-off data among performance data that is generated based on the string vibration signal, and outputs specified performance data other than the note-on data and the note-off data when the predetermined performance operation mode is selected by operating the operation member.

In accordance with another embodiment of the present invention, the performance data generation apparatus includes a pitch difference detection device that detects a pitch difference between a pitch of a first string vibration signal obtained in response to a note-on event of a tone that is currently generated and a pitch of a second string vibration signal that is newly obtained after the predetermined operation mode is selected. The control device outputs pitch bend data as performance data representative of a pitch bend amount that corresponds to the pitch difference detected by the pitch difference detection device.

As a result, when a note is played after the sustain mode or the hold mode is turned on by operating, for example, a sustain pedal or a hold pedal, note-on data and note-off data for the note are not outputted. However, other performance data such as pitch bend data is outputted. Accordingly, a performer can continuously perform pitch bend control over a sound source output note that is sustained or held, by adding pitch variation to a note that is played while the sustain mode or the hold mode is effective.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings.

DETAILED DESCRIPTION OF PREFERRED EMBODIMENTS

A performance data generation apparatus in accordance with embodiments of the present invention will be described hereunder with reference to FIGS. 1 through 9.

Figure 1:
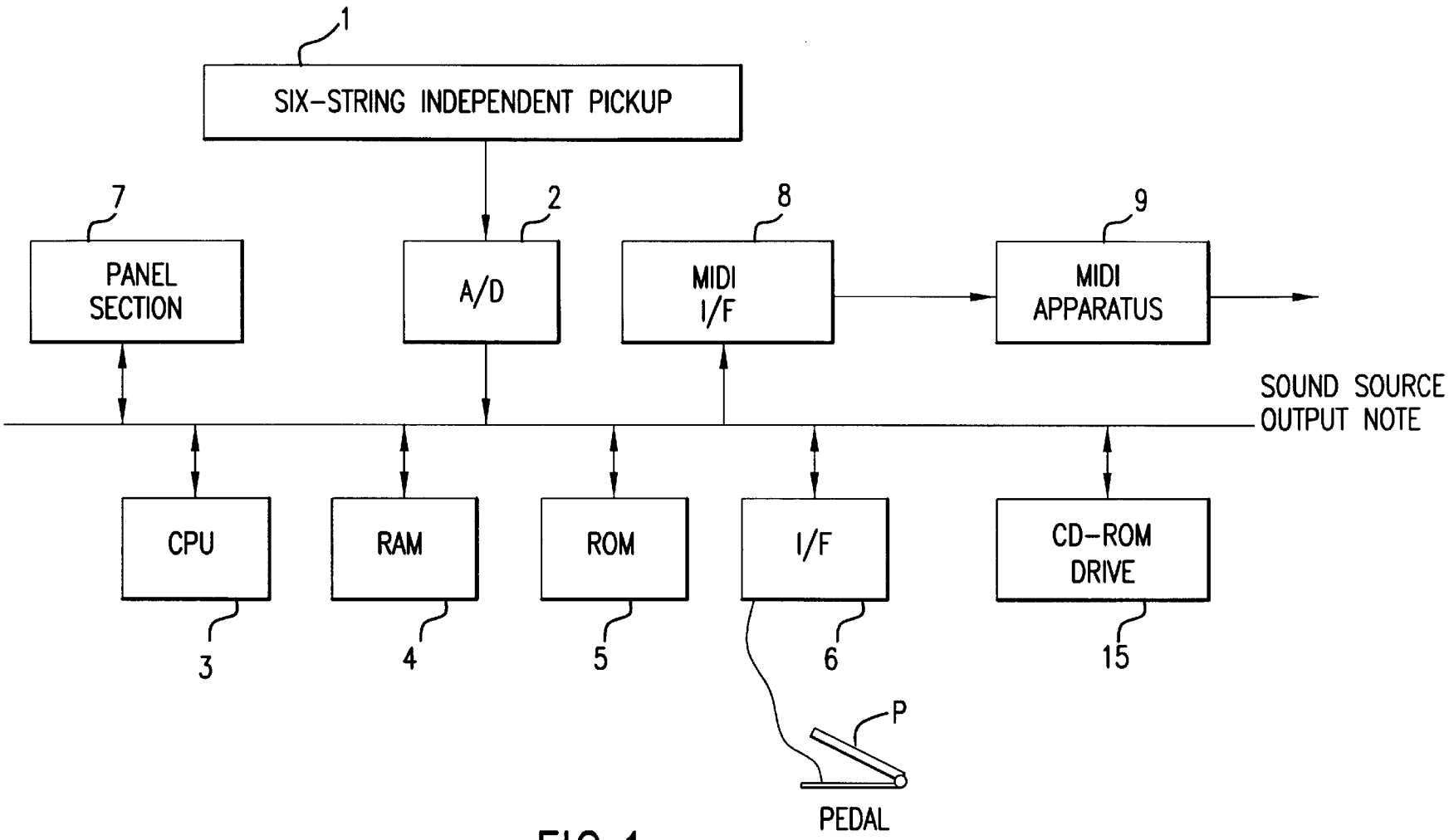
FIG. 1 shows a block diagram of a guitar synthesizer in accordance with an embodiment of the present invention.

FIG. 1 shows a block diagram of a guitar synthesizer equipped with a performance data generation apparatus in accordance with one embodiment o the present invention.

In FIG. 1, a six-string individual pickup 1 is mounted on a guitar (not shown). The six-string individual pickup 1 is located, for example, adjacent the bridge of the guitar for detecting vibrations of the first string through the sixth string independently from one another and outputs corresponding electrical signals.

It is noted that a performance data generation apparatus in accordance with embodiments of the present invention may be implemented in a synthesizer apparatus for a stringed instrument having more than six strings. In such a case, a pickup device is designed to detect string vibrations of the corresponding number of strings independently from one another and output corresponding electrical signals.

An A/D (analog-to-digital) converter 2 converts the electrical signals provided by the six-string individual pickup 1 to corresponding digital signals.

A CPU (central processing unit) 3 executes a variety of process operations to generate MIDI performance data signals for driving a MIDI apparatus 9 based on the signals for the six strings provided through the A/D converter 2.

A RAM (random access memory) 4 stores a variety of data sets that are generated during process control and calculation process performed by the CPU 3. A ROM (read only memory) 5 stores program data and the like for executing a variety of controls performed by the CPU 3.

A pedal interface 6 is connected to an external pedal P for supplying operation data of the pedal P to the CPU 3. The CPU 3 executes a process of generating MIDI signals representative of control parameter data in response to the operation data of the pedal P.

A panel 7 includes a key operation section (not shown) for performing a variety of operations, including selection of tone colors to be generated by a sound source apparatus and MIDI channels to be used, switching between different modes and the like. The panel 7 also includes a display apparatus, such as, for example, a liquid crystal panel, and LED (light emitting diode) (not shown), for displaying operational conditions of the guitar synthesizer. The CPU 3 executes process operations in response to operation data provided by the key operation section and executes display controls for the display apparatus.

A MIDI interface 8 operates as an interface to the MIDI apparatus 9 and the CPU 3 through which MIDI signals generated by the process operation of the CPU 3 are supplied to the MIDI apparatus 9.

In one embodiment, the MIDI apparatus 9 is built in the guitar synthesizer and includes a sound source apparatus for generating a variety of tone colors. The MIDI apparatus 9 generates tones having tone colors that are selected by the sound source apparatus based on the MIDI signals supplied through the MIDI interface 8. In an alternative embodiment, the MIDI apparatus 9 is independently provided as an external MIDI apparatus.

In accordance with one embodiment of the present invention, the guitar synthesizer may be connected to a personal computer so that tone generation is additionally or independently controlled by the personal computer. In an alternative embodiment, all or a part of the functions of the guitar synthesizer may be performed by a personal computer or the like. In this case, program data for executing all or a part of the functions of the guitar synthesizer may be stored in a machine-readable media, such as, for example, a CD-ROM (compact disc read only memory) 15. A ROM (read only memory), a RAM (random access memory), a hard drive, a DVD (digital video disc) or the like may also be used as a machine-readable media.

Figure 2:
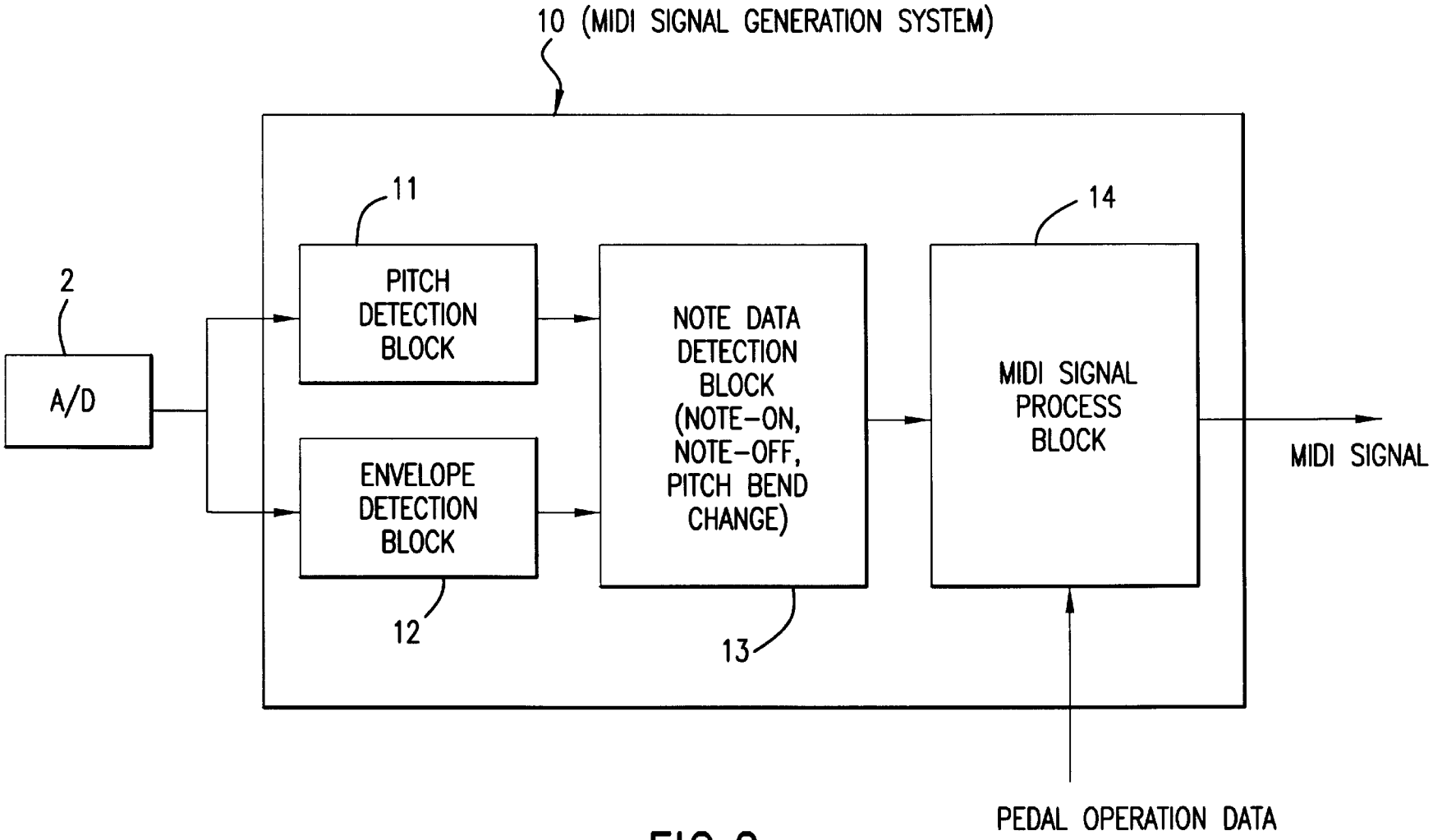
FIG. 2 shows a block diagram of a MIDI signal process represented by function unit blocks that are performed by a guitar synthesizer in accordance with one embodiment of the present invention.

FIG. 2 shows function unit blocks representative of the process operation for generating MIDI signals performed by the guitar synthesizer in accordance with the embodiment shown in FIG. 1. In effect, the process for generating MIDI signals is primarily achieved as a result of the process executed by the CPU 3.

In FIG. 2, string vibration signals that are provided by the six-string individual pickup 1 are converted by the A/D converter 2 to digital signals and then supplied to a pitch detection block 11 and an envelope detection block 12 in a function unit block labeled as a MIDI signal generation system 10. The pitch detection block 11 detects pitches of the respective strings based on the inputted string vibration signals and transmits pitch data sets representative of the detected pitches of the respective strings to a note data detection block 13. The envelope detection block 12 detects envelopes (each representative of an intensity (magnitude) of a tone) of the respective strings based on the inputted string vibration signals, and transmits envelope data sets representative of the detected envelopes to the note data detection block 13.

The note data detection block 13 generates a variety of note data required for generating a variety of MIDI signals based on the inputted pitch data and envelope data and supplies the data to a MIDI signal process block 14. The note data generated by the note data detection block 13 includes note-on data representing that the string starts generating a tone, note-off data representing that the string vibration of the string is stopped, pitch bend data representing a magnitude of change in the pitch of each tone and the like.

The operations performed by the above-described A/D converter 2, the pitch detection block 11, the envelope detection block 12 and the note detection block 13 are executed for each of the string vibration signals outputted by the six-string individual pickup 1 independently from one another.

The MIDI signal process block 14 performs a process operation for generating MIDI signals for driving the sound source apparatus of the MIDI apparatus based on a variety of note data supplied from the note detection block 13 and pedal operation data supplied from the pedal P shown in FIG. 1.

Figures 10A, 10B, 10C:
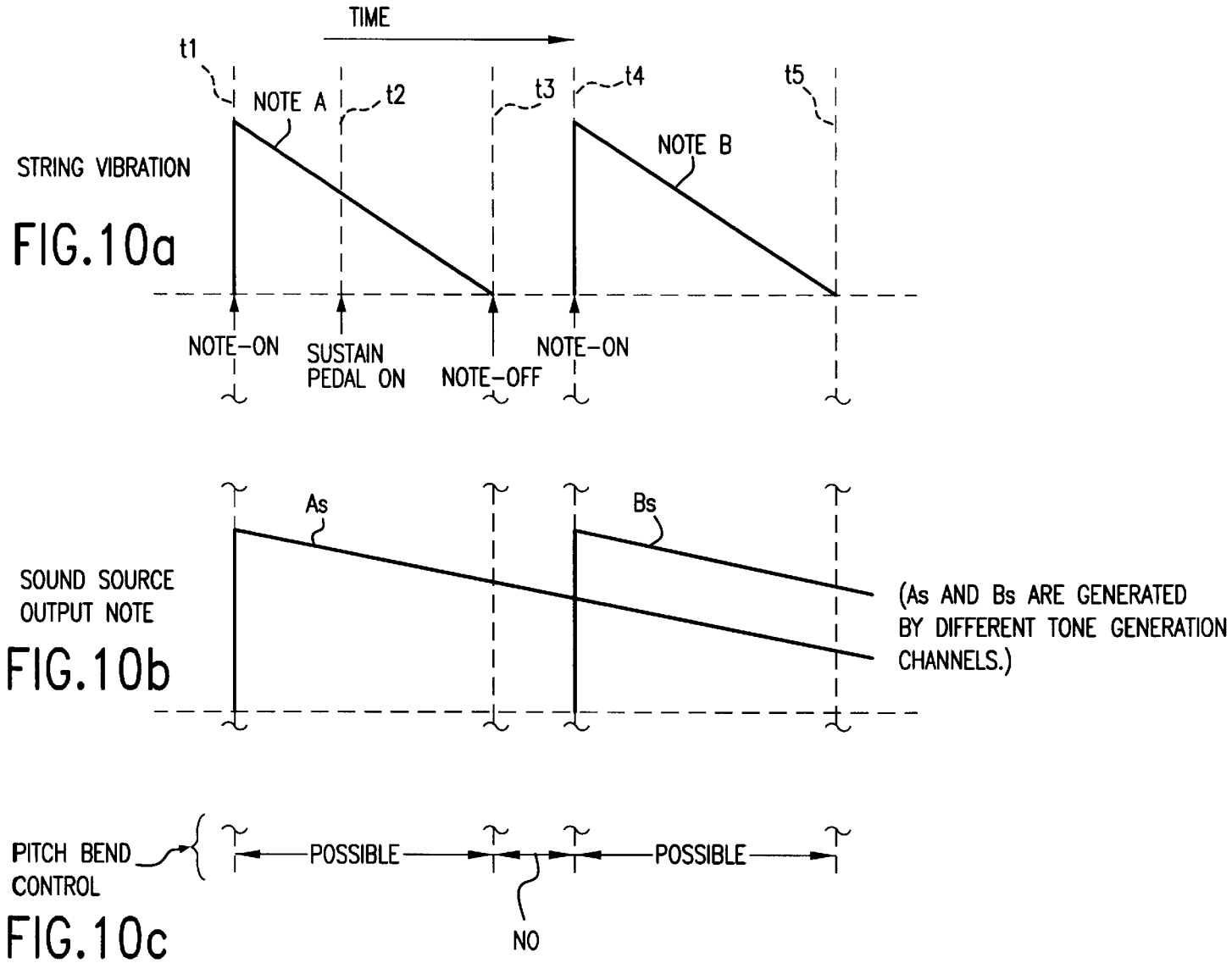
FIGS. 10 (*a*)–10 (*c*) show envelopes of string vibrations, envelopes of sound source output notes and availability of pitch bend control, respectively, obtained in a performance method using an ordinary sustain mode.
Figure 11A:
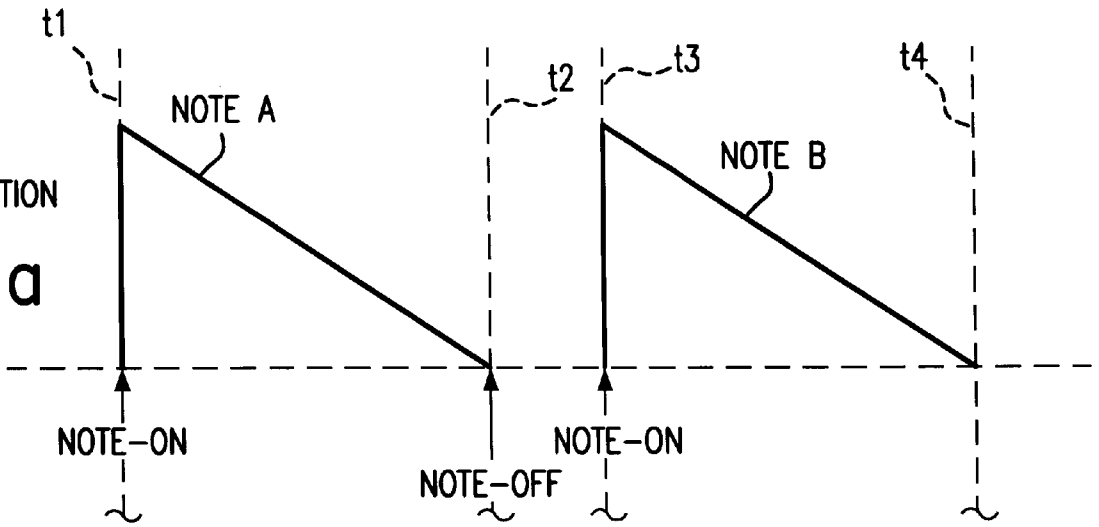
FIGS. 11 (*a*) and 11 (*b*) show envelopes of string vibrations and envelopes of sound source output notes, respectively, obtained in a performance method using an ordinary holding mode.
Figure 11B:
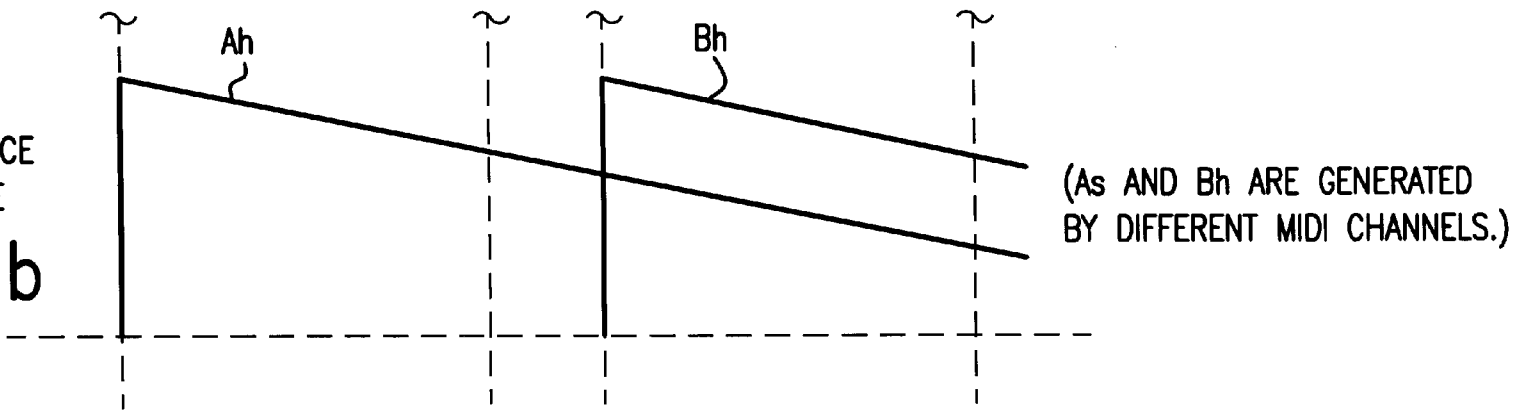

The guitar synthesizer having the structure described above in accordance with one embodiment of the present invention performs the sustain mode and the hold mode described above with reference to FIGS. 10 and 11. In addition, the guitar synthesizer performs a "sustain and bend control mode" and a "hold and bend control mode", in which pitch bend control is continuously performed on a sound source output note that is sustained or held. In a preferred embodiment, the guitar synthesizer performs a performance mode in which pitch bend control is continuously performed on a sound source output note that is sustained or held even after a note corresponding to the sound source output note is completely attenuated.

Figure 3A:
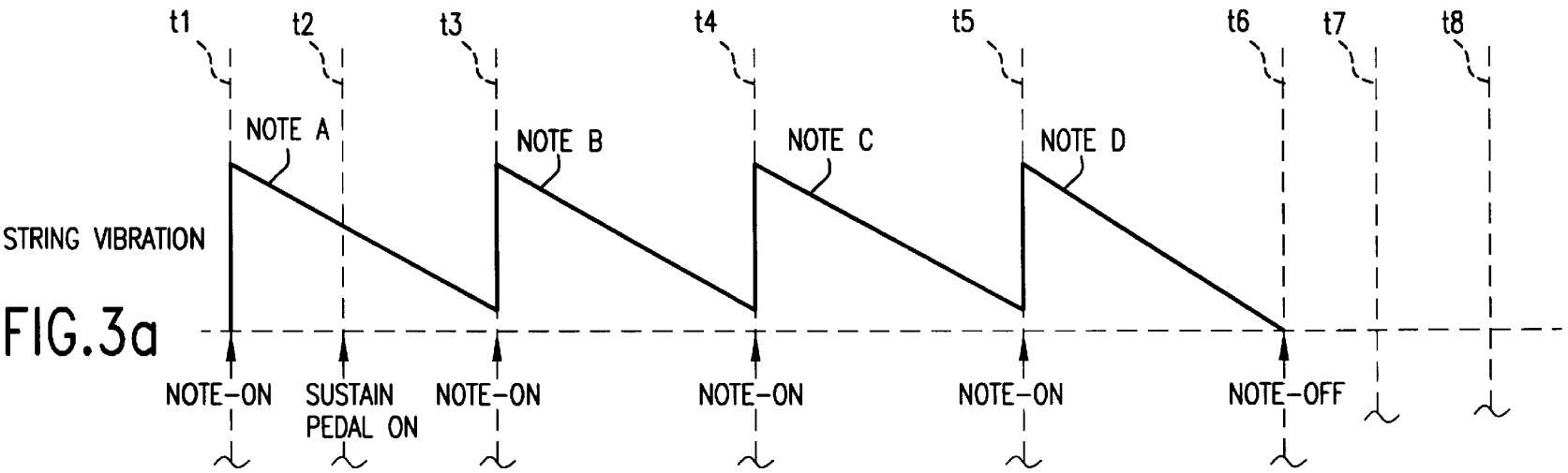
FIGS. 3 (*a*) and 3 (*b*) show envelopes of string vibrations and an envelope of a sound source output note, respectively, generated in a performance method using a sustain and bend control mode in accordance with one embodiment of the present invention.
Figure 3B:
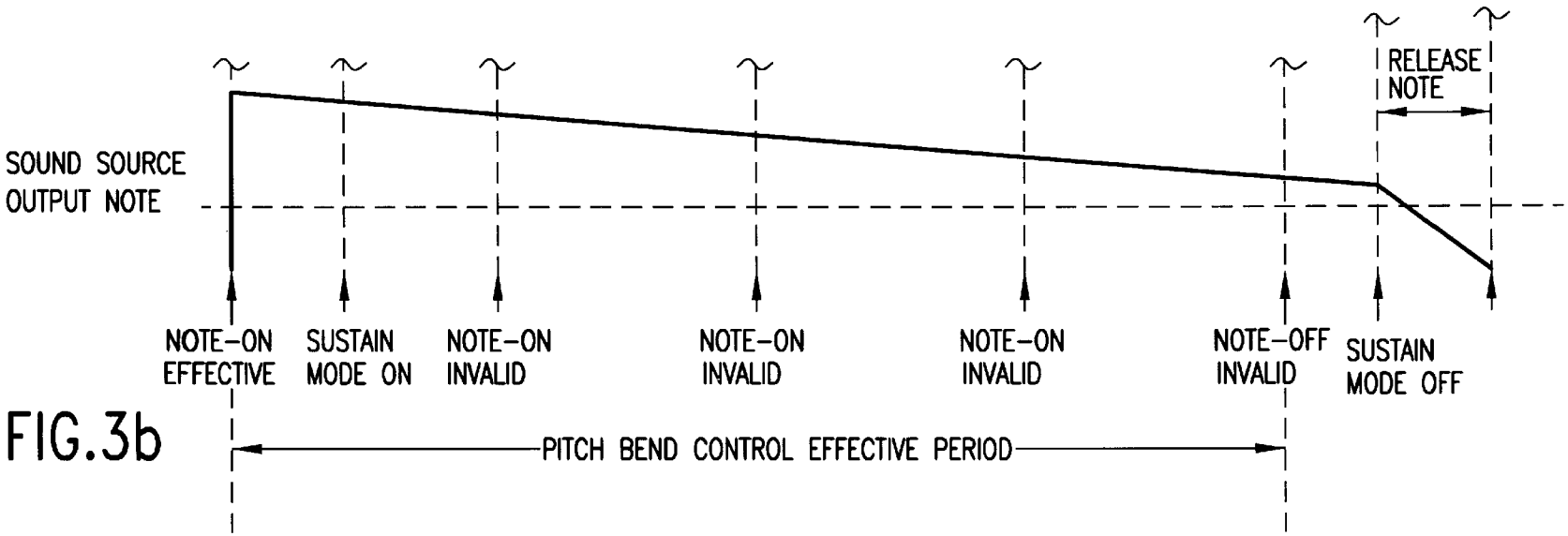

One example of a performance method achieved by the guitar synthesizer by using the sustain and bend control mode will be described with reference to FIGS. 3 (*a*) and 3 (*b*). FIG. 3 (*a*) schematically shows an envelope of string vibration for a note played by the guitar, and FIG. 3 (*b*) schematically shows an envelope of a sound source output note outputted from the MIDI apparatus 9 that is generated based on the string vibration and the operation data of the sustain pedal.

In this embodiment, a performer operates the panel section 7 of the guitar synthesizer in advance to pre-set a condition in which on/off control of the sustain and bend control mode is performed by operation of the pedal. In an alternative embodiment, an ordinary pedal for the sustain mode and another pedal for the sustain and bend control mode may be provided so that these modes are turned on and off independently of each other.

When a performer picks one of the strings to play a first note A at time t1 shown in FIG. 3 (*a*), a MIDI signal representative of a note-on message for the note A is generated and supplied to the MIDI apparatus 9. As a result, a sound source output note As corresponding to the note A is outputted at time t1 shown in FIG. 3 (*b*).

In this case, the performer operates the sustain pedal at time t2 while the note A is in a note-on state. By this operation, the sustain and bend control mode is turned on, and the sound source output note As is sustained after time t2 at a predetermined sustain rate set for the corresponding tone color without regard to the actual attenuation of the string vibration signal for the note A.

At the same time, the performer continuously adds pitch variation to the note A that is played at time t1 by using one of the above-described pitch bend performance methods. The guitar synthesizer generates a MIDI signal representative of pitch bend data for the pitch variation. Accordingly, the sound source output note As has a pitch bend effect corresponding to the pitch variation of the note A.

In the embodiment shown in FIG. 3 (*a*), the performer plays a note B at time t3 when the note A is not completely attenuated, and the note A and the note B are played on the same string.

In accordance with one embodiment of the present invention, in the sustain and bend mode control, note-on data generated in response to the note B is considered to be invalid. In other words, a specified process is performed so that a note-on message corresponding to the note B is not outputted as a MIDI signal to the MIDI apparatus 9. It is noted that the note A substantially reaches a note-off state at time t3. However, note-off data for the note A is invalidated, and the sound source output note As is continuously sustained. This particular operation is performed by the ordinary sustain mode in a similar manner.

However, in the ordinary sustain mode, as described above with reference to FIGS. 10 (*a*) through 10 (*c*), note-on data is effective and a new sound source output note is generated using another tone generation channel. In contrast, in the sustain bend control mode in accordance with one embodiment of the present invention, note-on data is invalidated so that a new sound source output note corresponding to the note B is not generated, and the sound source output note As alone is continuously sustained as shown in FIG. 3 (*b*).

It is noted that among MIDI signals that are generated after time t3 in response to the note B, only note-on data is invalidated, other message data sets including pitch bend data for the note B are effective and outputted to the MIDI apparatus 9. Therefore, if the performer adds pitch variation to the note B, a control of adding pitch variation to the sound source output note As can be continued even after time t3.

As shown in FIG. 3 (*a*), the note B is then followed by a note C that is played at time t4 (on the same string as the note A was played), and the note C is followed by a note D that is played at time t5 (on the same string as the note A was played). Even after time t4, note-on data for the newly played note C and note D is invalidated. As a result, no sound source output notes corresponding to the note C and note D are generated, and the sound source output note As alone is continuously sustained. Also, the performer can add pitch variation to the note C and note D to continue pitch bend control over the sound source output note As. In the illustrated embodiment, as shown in FIG. 3 (*a*), the note D attenuates to a note-off state at time t6. However, note-off data representative of the note-off state is also treated as being invalid, the sound source output note As is continuously sustained after time t6. In the embodiment shown in FIGS. 3 (*a*) and 3 (*b*), no new note is played after time t6, and therefore the pitch bend control cannot be performed by the performer after time t6.

In the illustrated embodiment, the performer operates the sustain pedal at time t7 to turn off the sustain bend control mode when a certain time has passed after time t6. As a result, a MIDI signal for a sustain-off message is generated. In response, the sound source output note As is attenuated at time t7 and thereafter at a specified release rate that is set for a tone color currently being generated, and generation of the sound source output note As is completed at time t8 when the release tone fades out.

It is appreciated from the above that sound generation is controlled so that during the sustain and bend control mode, MIDI signals for note-off data are invalidated and note-on data for notes that are played are also invalidated. As a result, a sound source output note generated in response to an initially played note alone is continuously generated and sustained. In addition, a new note is played by the guitar while the sound source output note is sustained and pitch variation is added to the new note so that the pitch bend control over the sound source output note can be continuously performed.

Accordingly, the guitar synthesizer enables a performance method that cannot be achieved by the normal sustain mode; that is, a performance method in which a single sound source output note is sustained and at the same time pitch bend is added to the sound source output note. In the illustrated embodiment shown in FIG. 3, the pitch bend control can be continuously performed over the sound source output note As during a period between time t1 when the note A is played and time t6 when the sustain and bend control mode is turned off.

To achieve the above-described pitch bend control effect by using the sustain and bend control mode in a manner desired by a performer, a process control in accordance with a preferred embodiment is performed over pitch bend value data (pitch bend data) for a MIDI signal in a manner described below with reference to FIGS. 4 (*a*) through 4 (*c*).

Figure 4A:
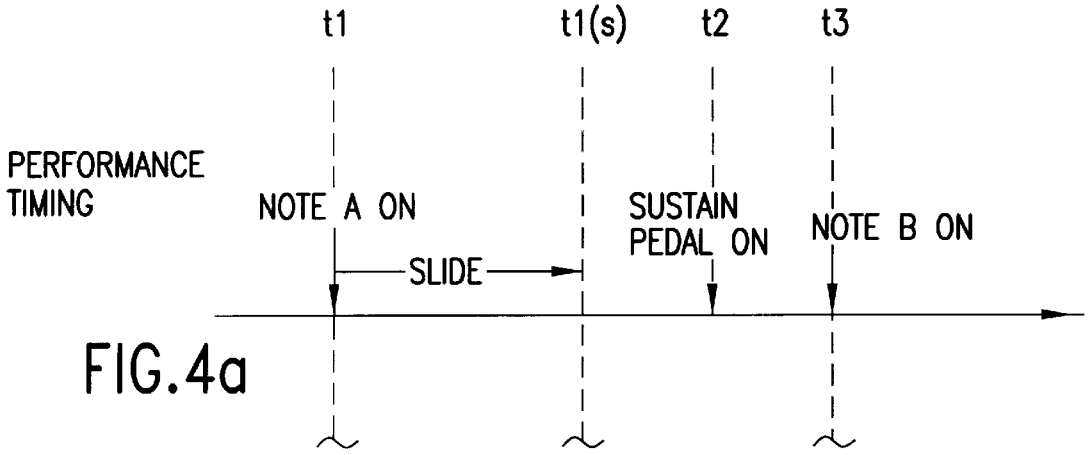
FIGS. 4 (*a*)–4 (*c*) show a performance timing, a first pitch change of a sound source output note and a second pitch change of a sound source output note, respectively, in a pitch control operation in a sustain and bend control mode.
Figure 4B:
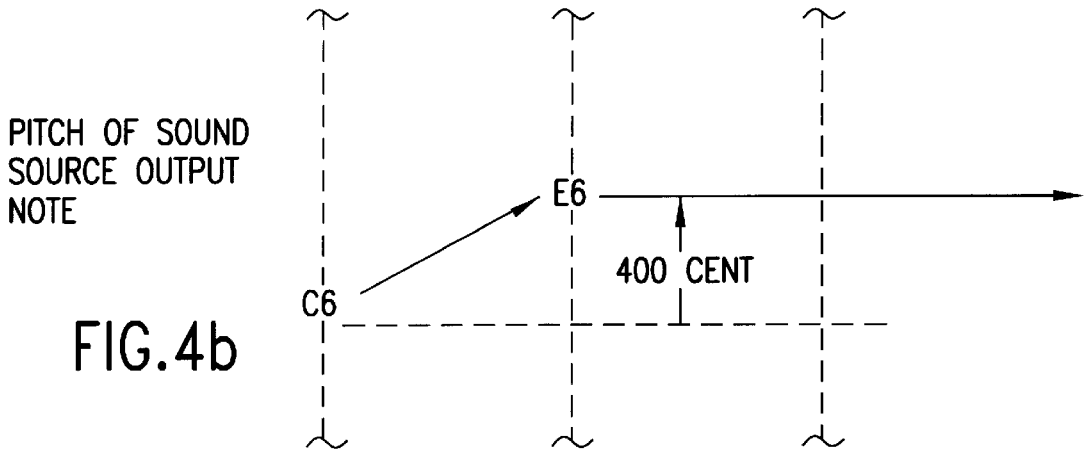
Figure 4C:
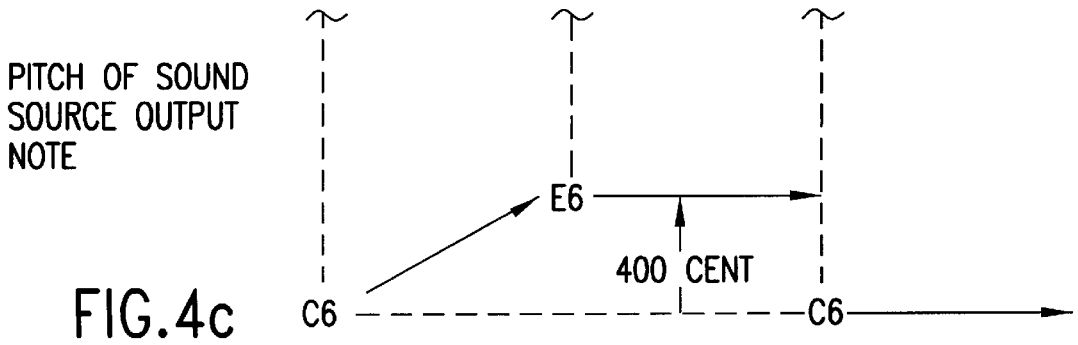

FIG. 4 (*a*) shows a performance timing performed by a performer. FIGS. 4 (*b*) and 4 (*c*) show pitch changes in sound source output notes corresponding to the performance timing. FIG. 4 (*b*) shows pitch changes in a sound source output note that is obtained by the sustain and bend control mode in accordance with an embodiment of the present invention.

Let us assume that the guitar is normally tuned and a note A is played to start a note-on state at time t1 shown in FIG. 4 (*a*).

In the illustrated embodiment, the note-on state of the note A is started by playing note C6 at the eighth fret on the first string. In the sliding performance, for example, the performer slides the finger that depresses the first string from the initial position (the eighth fret) to the twelfth fret of the first string, ending at time t1 (s), in order to change the pitch from note C6 to note E6. This state is shown in FIGS. 4 (*b*) and 4 (*c*). While note E6 is continuously generated, the performer turns on the sustain and bend control mode at time t2.

When the performance is carried out in the manner described above, the pitch detection block 11 (shown in FIG. 2) detects the pitch of note C6 upon the note-on event of the note A at time t1. As a result, a MIDI note-on data signal corresponding to the note A includes scale data indicative of note C6. Then, changes in the pitch will be successively detected as the finger is shifted from one fret to another in the slide performance. When the performer has slid the finger from note C6 to note E6, pitch bend value data of +400 cent (that corresponds to a tone difference of four semitones between note C6 and note E6) is generated by the MIDI signal process block 14 and a MIDI signal representative of the pitch bend value data is outputted. In association with the performance timing, the pitch of the sound source output note As is bent from note C6 to note E6.

In the illustrated embodiment, the sustain and bend control mode is turned on at time t2 as shown in FIG. 4 (*a*), and the performer plays a note B at time t3 while the performer is depressing the first string at the twelfth fret and note E6 is generated.

At this time, based on a signal for the note B that is inputted to the guitar synthesizer, the pitch detection block 11 detects a tone of note E6. As a result, a MIDI note-on data signal representative of the note B includes scale tone data indicative of note E6, and the pitch bend value data is reset to zero (0) cent.

As described above, only note-on data for a note that is newly played during the sustain and bend control mode is not outputted to the MIDI apparatus, and pitch bend data is treated as effective. As a result, if the sound source apparatus were driven based on the pitch bend value data of zero (0) cent that is obtained at the note-on event of the note B, the pitch bend value of +400 cent that has been effective until time t3 would be reduced to zero (0) cent. However, the scale tone data for the currently effective note is representative of note C6 that was generated upon the note-on event of the note A. As a result, an inconvenient incident occurs. For example, although the performer plays note E6 on the guitar, the pitch of the sound source output note changes from E6 to C6, as shown in FIG. 4 (*c*).

As a counter measure, in accordance with one embodiment of the present invention, each time a new note is played during the sustain and bend control mode, a pitch difference between a pitch of the currently generated sound source output note and a pitch of the newly played note is detected, and a pitch bend value corresponding to the detected pitch difference is added to the pitch bend data that was generated upon the note-on event of the currently generated sound source output note and that has been effective until the current moment.

For example, in the case shown in FIG. 4, scale tone data for the note A that is obtained at the note-on event of the note A is representative of the note of C6, and pitch bend data for the note A is representative of zero cent. At the note-on event of the note B, the scale tone for the note B is representative of note E6, and therefore a pitch difference of 400 cent between the note A and the note B is detected. Although pitch bend value data to be outputted at time t3 is reset to zero cent as described above, the pitch difference of 400 cent is added to the pitch bend value data for the note A. As a result, as shown in FIG. 4 (*b*), a sound source output note having a pitch of note E6 is generated at time t3 and thereafter, so that the pitch of the sound source output note corresponds to the pitch of the note that is actually played on the guitar by the performer.

FIGS. 4 (*a*)–4 (*c*) show an embodiment in which the slide performance method is performed. However, when pitch variation is added by any one of the other pitch bend performance methods described above, such as, for example, the choking performance method, a sound source output note is also controlled to have a pitch that corresponds to a pitch of an actually performed note in the same manner as described with reference to FIGS. 4 (*a*)–4 (*c*). Further, in the embodiment described above with reference to FIGS. 4 (*a*)–4 (*c*), the pitch is increased to a higher level. However, in an alternative embodiment, the pitch can be decreased to a lower level to achieve a similar result. In this case, pitch bend data is obtained by subtracting a pitch bend value corresponding to a detected pitch difference from a pitch bend value for a note that is played before the sustain and bend control mode is turned on.

Process operations executed by the CPU 3 to achieve the above-described sustain and bend control mode in accordance with one embodiment of the present invention will be described below with reference to flow charts shown in FIGS. 5 through 8. The process operations shown in FIGS. 5 through 8 are executed by one of the functional unit blocks shown in FIG. 2, that is, the MIDI signal process block 14 within the MIDI signal generation system 10.

Figure 5:
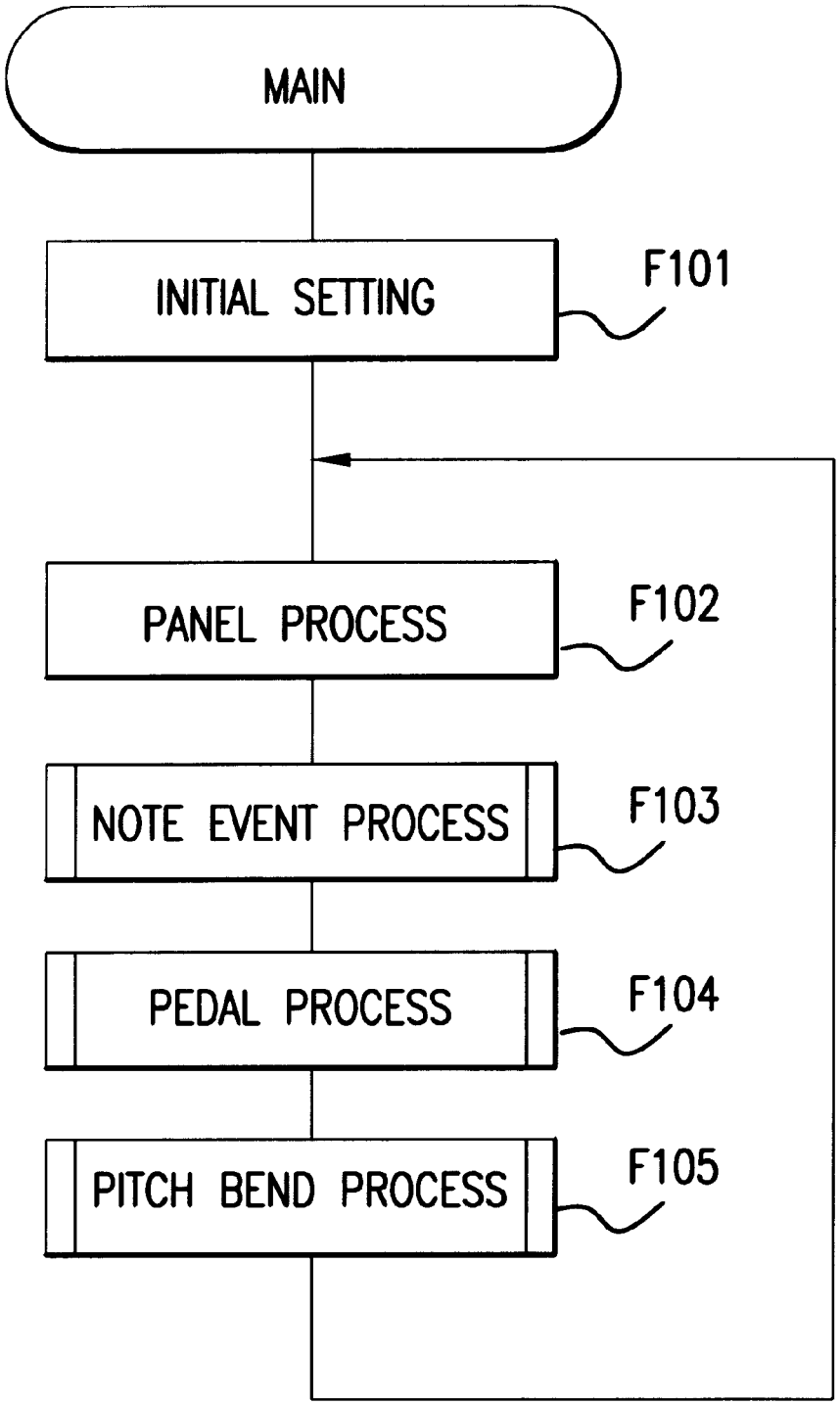
FIG. 5 shows a flow chart of a main routine of a MIDI signal process performed by a guitar synthesizer in accordance with one embodiment of the present invention.

FIG. 5 shows a main routine that is executed by the CPU 3 for generating MIDI signals.

In an initial setting process in step F101 of the main routine, a variety of initial settings for the basic operation of the guitar synthesizer are executed.

A panel process is executed in step F102 in which, after the initial setting was performed in step F101, a variety of processes are executed in response to operation data provided by the key operation section of the panel section 7. For example, in response to the operation of keys provided at the panel section 7, a variety of switch settings are enabled. For example, a tone color to be generated by the sound source apparatus is selected, and a variety of modes including the sustain and bend control mode in accordance with an embodiment of the present invention are selected. Also, display control over a display apparatus (not shown) provided at the panel section 7 is executed in response to operation settings of the guitar synthesizer.

In steps F103 and F104, processes are executed in response to the operation settings of the guitar synthesizer that are set in the above-described steps F101 and F102.

In step F103, a note event process is executed to generate MIDI signals for note-on data and note-off data based on a string vibration signal for each of the strings provided by the six-string independent pickup 1. In step F104, a pedal process is executed to generate a variety of message data sets for controlling the MIDI apparatus 9 in response to pedal operation under the selected modes. In step F105, a pitch bend process is executed to generate pitch bend data based on a change in pitch data signals representative of string vibrations of the guitar string.

After the initial setting in step F101 in the main routine, processes in steps F102 through F105 are repeatedly executed to generate MIDI signals in response to string vibration signals provided from the guitar, and the MIDI apparatus 9 is driven based on the MIDI signals.

Next, the note event process (in step F103), the pedal process (in step F104) and the pitch bend process (in step F105) to be executed when the sustain and bend control mode is set in step F102 will be described with reference to FIG. 6, FIG. 7 and FIG. 8, respectively.

Figure 6:
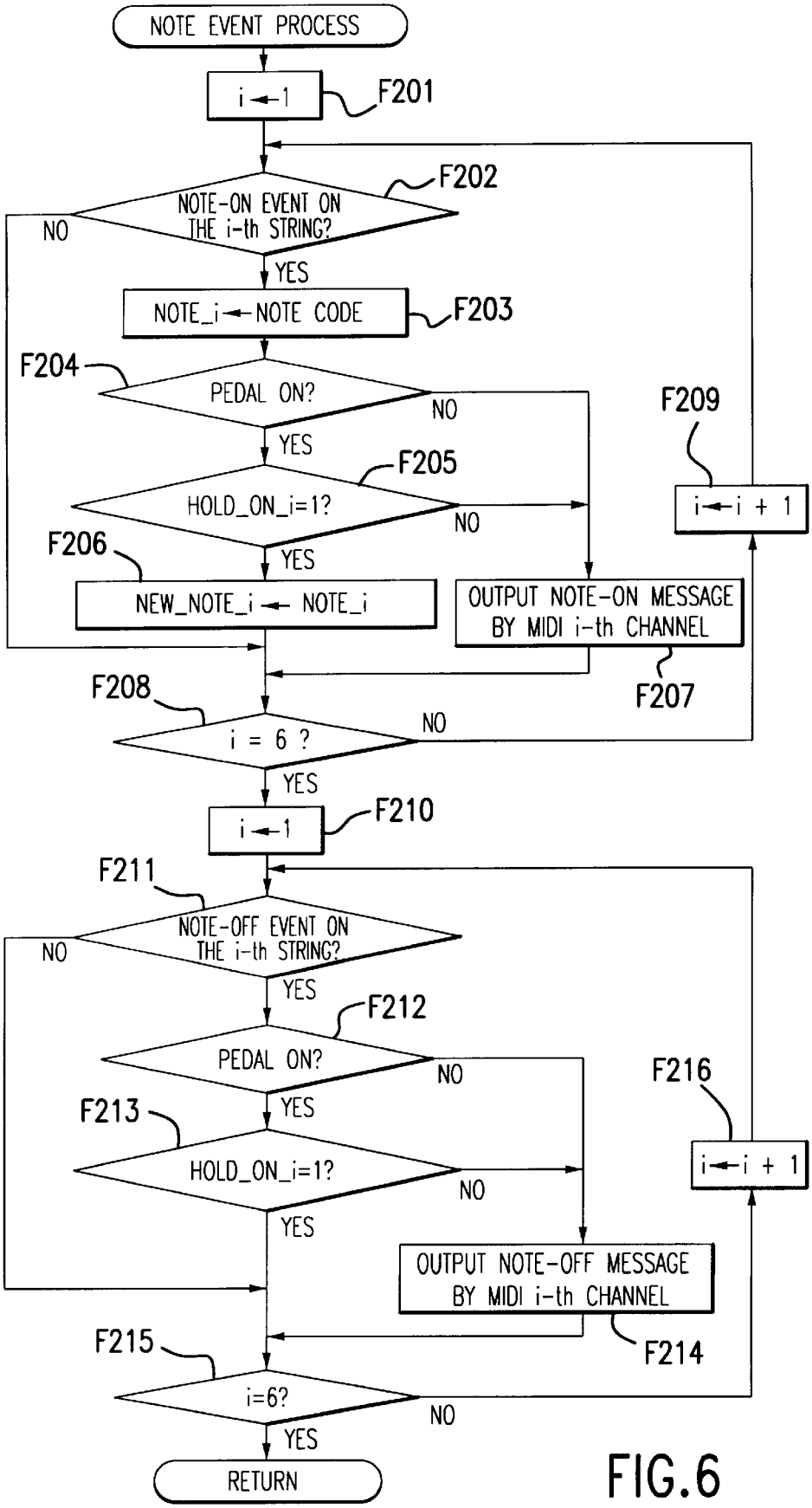
FIG. 6 shows a flow chart of a note event process of a MIDI signal process in accordance with one embodiment of the present invention.

In accordance with a routine of the note event process shown in FIG. 6, a register i is set to "1" in step F201. The value of the register i corresponds to each of the guitar strings (in other words, a string vibration signal for each of the strings outputted from the six-string independent pickup 1). In a preferred embodiment, the guitar synthesizer is connected to a six-string guitar and responsive to six string vibration signals, and therefore the value of the register i takes one of "1" through "6".

In step F202, a determination is made whether there is a note-on event on an i-th string that corresponds to the value set in the register i. In other words, a determination is made whether the note data detection block 13 shown in FIG. 2 detects note-on data in response to a picking operation at the i-th string. When note-on data is not detected in step F202, and a determination "no" is made, the process proceeds to step F208.

In contrast, when note-on data is detected, and a determination "yes" is made in step F202, the process proceeds to step F203. In step F203, a tone scale register Note_i is set to a note code corresponding to a detected pitch based on pitch data that is detected upon the note-on event by the pitch detection block 11.

Note codes are defined by the MIDI standard. For example, codes 0 through 127 are assigned to the respective semitones in a tone range between note C2 and note G6, and each of the codes is expressed by one byte data.

In step F204, a determination is made whether a mode (to be set by the pedal operation) is set to a "pedal-on" state (for example, to the sustain and bend control mode in accordance with one embodiment of the present invention). When a mode is set to a "pedal-off" state, a determination "no" is made, and the process proceeds to step F207 in which a note-on massage for the i-th string is transmitted through a MIDI i-th channel.

In other words, a normal operation mode is set in the above-described case where the mode is set to the "pedal-off" state, and therefore a note-on massage is generated based on the note-on data for the i-th string that is detected by the note data detection block 13. The note-on message includes scale tone data (note code) and velocity data for the i-th string that is played.

When a determination "yes" is made in step F204, indicating that the pedal-on state is set, a determination is made in step F205 whether a register Hold_on_i is set to "1". The register Hold_on_i is a flag that indicates, when a specified mode is set by the pedal operation, whether the mode has already been effective for the i-th string. When the mode is effective for the i-th string, the register Hold_on_i is set to "1", and when the mode is not effective for the i-th string, the register Hold_on_i is set to "0".

In the case where the sustain and bend control mode is set, a determination is made whether the sustain and bend control mode has already been effective for the i-th string during the note-on event for the i-th string. In other words, a determination is made whether a sustain effect has already been set by the sustain and bend control mode for a sound source output note that has already been generated in response to the picking operation on the i-th string.

When a determination "no" is made in step F205, the sustain effect is not currently set by the sustain and bend control mode for the i-th string, and the process proceeds to step F207 in which a note-on message for the i-th string is transmitted through the MIDI i-th channel. In other words, such a determination indicates that the i-th string is newly picked, and note-on data for the i-th string is rendered effective.

On the other hand, when a determination "yes" is made in step F205, the sustain effect has already been effective on the i-th string by the sustain and bend control. mode. In this case, the process proceeds to step F206, in which the note code that has been set to the register Note_i in the previous step F203 is set to a register New_note_i. Then the process proceeds to step F208.

The data set to the register New_note_i is used in the pitch bend process (which will be described later) for controlling pitch bend values described above with reference to FIGS. 4 (*a*)–4 (*c*).

According to the processes executed in steps F205, F206 and F208, when a new note is played by picking one of the strings that has already been providing note data in the sustain and bend control mode, note-on data for the new note is invalidated, and a MIDI signal for a corresponding note-on message is not outputted. For example, in the case described above with reference to FIGS. 3 (*a*) and 3 (*b*), note-on data for the note B, the note C and the note D played at time t3, t4 and t5, respectively, are invalidated.

In step F208, a determination is made whether the register i is currently set to "i=6". In other words, a determination is made whether the above-described processes in steps F202 through F207 have been executed for each of the strings. A determination "yes" is made when the processes relating to note-on messages for all the strings have been completed, and the process proceeds to step F210 to start the following process steps relating to a note-off message. When a determination "on" is made, the process proceeds to step F209 in which the value of the register i is increased by one, and then returns to step F202, so that the same processes are executed for a string next to the i-th string.

After step F210, the processes for generating a note-off message are executed. In step F210, the register i is set to "1", and a determination is made in step F211 whether a note-off event occurs with respect to the i-th string. It is noted that the note data detection block 13 shown in FIG. 2 detects a note-off event. When a determination "no" is made in step F211, the process proceeds to step F215. When a determination "yes" is made in step F211, a determination is made in step F212 whether the pedal-on state is set.

A determination "no" is made in step F212 when the pedal-off state is set. Then, a normal mode process is executed, in other words, a note-off message for the i-th string is outputted through the MIDI i-th channel. On the other hand, a determination "yes" is made in step F212 when the pedal-on state is set. Then, the process proceeds to step F213.

In step F213, a determination is made whether the register Hold_on_i is set to "1". When it is not set to "1" ("no"), a note-off message for the i-th string is outputted through the MIDI i-th channel. On the other hand, a determination "yes" is made when a sustain effect has already been effective for the i-th string with which the note has been detected, and a note-off message for the i-th string is not outputted, or invalidated, and the process proceeds to step F215. As a result, a sound source output note corresponding to a note generated by the i-th string to which the performer is adding the sustain effect is continuously sustained at a predetermined sustain rate without regard to the state in which no string vibration is detected as a result of the attenuation of the i-th string.

By processes in steps F215 and F216, the above-described processes in steps F211 through F214 are executed for each of the strings, which is similar to the above-described processes in steps F211 through F214. When a determination "yes" is made in step F215, the processes relating to the note-off messages for all the strings are completed, and the process returns to the main routine.

Figure 7:
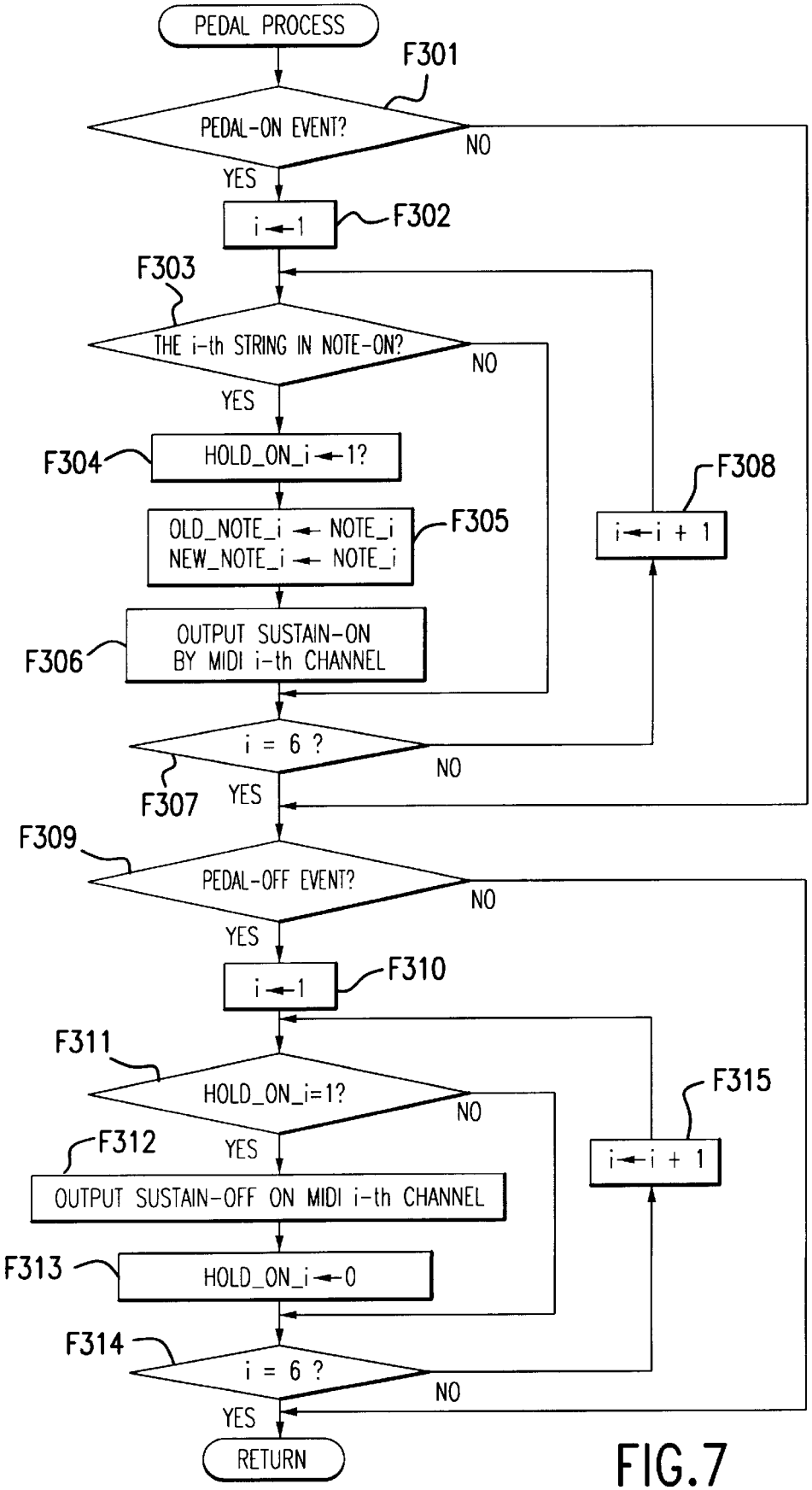
FIG. 7 shows a flow chart of a pedal process of a MIDI signal process in accordance with one embodiment of the present invention.

FIG. 7 shows processes for the pedal process. In accordance with the pedal process routine, a determination is made in step F301 whether a pedal-on event occurs. In other words, a determination is made whether a pedal operation for switching from a pedal-off state to a pedal-on state is performed (in a preferred embodiment, a determination is made whether the sustain and bend control mode is turned on). When a determination "no" is made, the process proceeds to step F309. On the other hand, when a determination "yes" is made, the register i is set to "1" in step F302, and the process proceeds to step F303.

A determination is made in step F303 whether the i-th string is currently in a note-on state, in other words, a determination is made whether the i-th string is played when the pedal is turned on, and the note data detection block 13 is detecting a string vibration signal of the i-th string.

When a determination is made in step F303 that the i-th string is not in the note-on state, the process proceeds to step F307. When a determination is made in step F303 that the i-th string is in the note-on state, then the process proceeds to step F304 in which the register Hold_on_i is set to "1". By this process, a sustain (or hold) effect is set for a sound source output note that is generated in response to a signal of the i-th string.

In step F305, the note code currently set to the register Note_i is set to each of a register Old_note_i and the register New_note_i. It is noted that the register Note_i holds the value set in the process in step F203 previously executed in the note event process shown in FIG. 6. The register Old_note_i is used together with the register New_note_i in the pitch bend process which will be described later.

After the above-described processes, message data indicative of the sustain-on state is outputted through the MIDI i-th channel in step F306. As a result, the MIDI apparatus 9 adds a sustain effect to a sound source output note corresponding to the signal of the i-th string. For example, in the case shown in FIGS. 3 (*a*) and 3 (*b*), a sustain effect is added to the sound source output note As corresponding to the note A.

By steps F307 and F308, the processes in steps F303 through F306 are executed for each of the strings. When all the processes relating to the pedal-on event for all of the six strings are completed, process operations relating to pedal-off events are started in step F309.

A determination is made in step F309 whether a pedal-off event (which is a pedal operation to turn off the sustain and bend control mode in accordance with a preferred embodiment) occurs. When a determination "no" is made, the routine of the pedal process is skipped. On the other hand, when a determination "yes" is made in step F309, the process proceeds to step F310 in which the register i is set to "1", and then to step F311.

In step F311, a determination is made whether the register Hold_on_i is set to "1". When the register Hold_on_i is not set to "1" indicating that the sustain effect is not set, the process proceeds to step F314 without a further process. When the register Hold_on_i is set to "1", indicating that the sustain effect is effective on a sound source output note corresponding to the i-th string, the process proceeds to step F312.

In step F311, the register Hold_on_i is not set to "1" when the i-th string is not picked, or when the i-th string is picked but the i-th string is not one of the strings on which the sustain effect is currently set in the sustain and bend control mode.

In step F312, a MIDI signal representative of message data for the sustain-off event is generated and outputted through the MIDI i-th channel. In step F313, the register Hold_on_i is set to "0", and the process proceeds to step F314. By the processes in step F312 and F313, the MIDI apparatus 9 turns off the sustain effect on the sound source output note corresponding to the i-th string, and fades out the sound generation at a predetermined release rate. The fade out operation corresponds to an operation taken place between time t7 and time t8 shown in FIG. 3 (*b*).

By the processes in steps F314 and F315, the above-described processes in steps F311 through F314 are executed for each of the strings, and then the process returns to the main routine.

Figure 8:
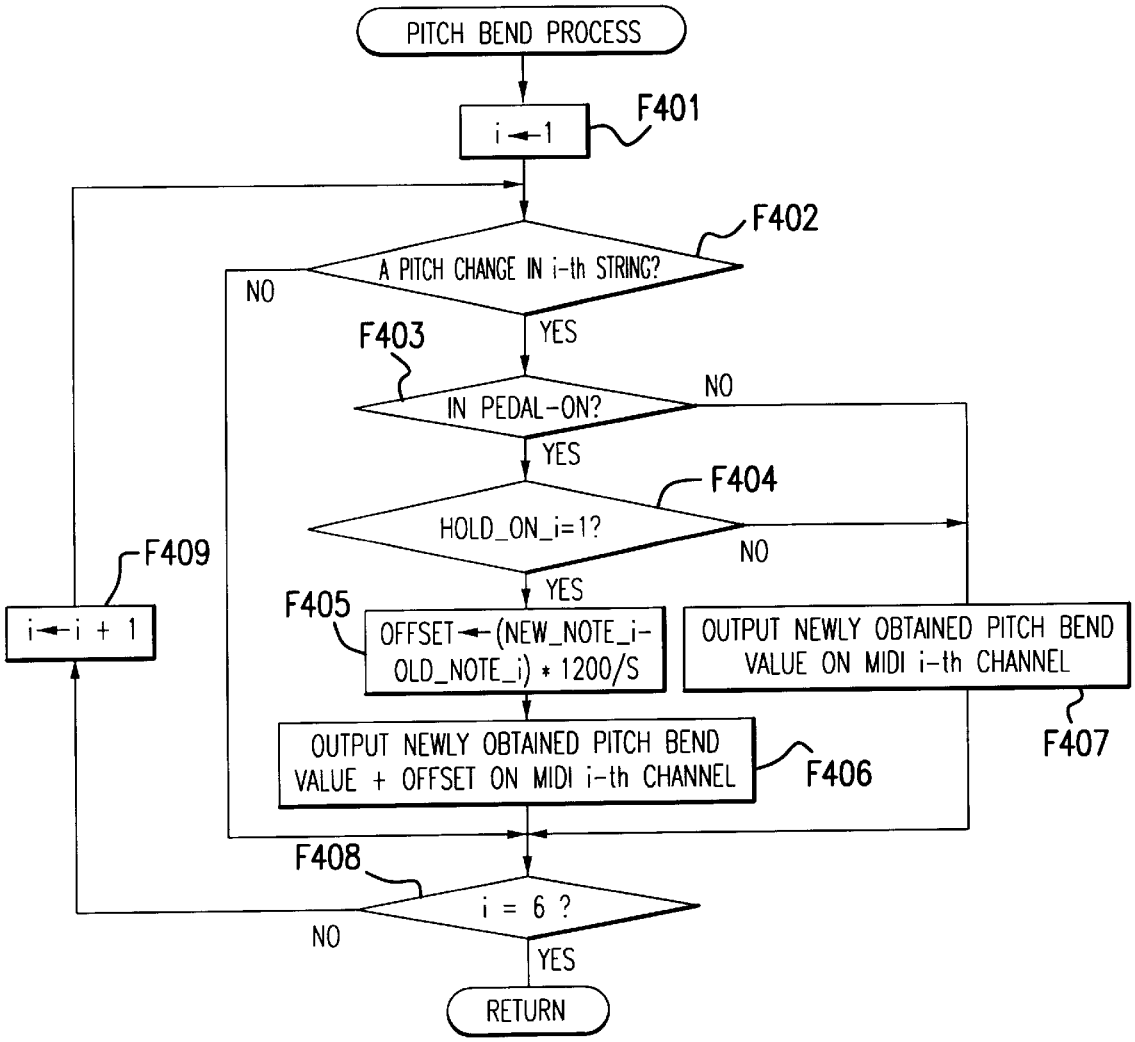
FIG. 8 shows a flow chart of a pitch bend process of a MIDI signal process in accordance with one embodiment of the present invention.

Next, FIG. 8 shows a routine of the pitch bend process in which processes to control pitches in the sustain and bend control mode described above with reference to FIGS. 4 (*a*)–4 (*c*) are executed.

In the pitch bend process routine, the register i is set to "1" in step F401, and then the process proceeds to step F402. In step F402, a determination is made based on pitch bend data detected by the note data detection block 13 whether a change in the pitch of the signal provided from the i-th string is present. When a determination "no" is made, indicating that a change in the pitch is zero "0", the process proceeds to step F408. When a determination "yes" is made, indicating that a change in the pitch is present, the process proceeds to step F403.

In step F403, a determination is made whether the pedal is in an on-state. When a determination "no" is made, the process proceeds to step F407 and a normal operation is performed, in other words, a MIDI signal representative of data for a pitch bend value is generated based on the newly obtained pitch change and outputted through the MIDI i-th channel. Then the process proceeds to step F408.

On the other hand, when a determination is made in step F403 that the pedal is in the on-state, the process proceeds to step F404 to execute processes in the sustain and bend control mode.

In step F404, a determination is made whether the register Hold_on_i s set to "1". When a determination "no" is made, the process proceeds to step F407. On the other hand, when a determination "yes" is made, indicating that a sustain effect is effective on a sound source output note corresponding to the i-th string, the process proceeds to step F405.

In step F405, a pitch control value OFFSET is calculated based on the note codes currently set at the register New_note_i and the register Old_note_i according to the following formula:

$$OFFSET=(New_note_i-Old_note_i)\times 1200/S \qquad \text{(Formula 1)}$$

where 1200 is a cent value for one octave, and S is a variable that defines, for example, the number of semitones included in one octave (for example, S=12). Therefore, the pitch control value OFFSET is defined by a pitch difference between the pitch indicated by the register New_note_i and the pitch indicated by the register Old_note_i which is expressed by a cent value in the unit of semitone.

In another embodiment, the variable S in Formula 1 may optionally be set by the user, for example, based on the key operation by the panel section 7. For example, the variable S may be set to a smaller number to achieve pitch bend control that is responsive to a more subtle pitch change. In this case, the sensitivity of the pitch bend detection is preferably modified in accordance with the change of the set value of the variable S.

The register New_note_i stores a note code representative of a pitch of the i-th string at the occurrence of a note-on event, that is set in step F206 in the note event process shown in FIG. 6. The Old_note_i stores a note code representative of a pitch of the i-th string that is in the note-on state when a pedal-on event occurred, that is set in step F305 in the pedal process shown in FIG. 7.

More specifically, in step F405, a pitch difference is obtained by comparing a pitch of the i-th string at the occurrence of a note-on event that is to be sustained by the sustain and bend control mode with a pitch of the i-th string detected when the i-th string is picked again during the sustain and bend control mode, and a cent value representative of the pitch difference is obtained.

In the case shown in FIG. 4 in accordance with one embodiment, the pitch of note C6 generated when the note A is played at time t1 is set to the register Old_note_i, and the pitch generated when the note B is played at time t3 is set to the New_note_i. Then in step F405, a pitch control value OFFSET is calculated based on Formula 1. As a result, the pitch control value OFFSET of +400 is obtained.

In step F406, new pitch bend data is obtained by adding the pitch control value OFFSET calculated in step F405 to a pitch bend value that is currently obtained. A MIDI signal representative of the new pitch bend data is outputted through the MIDI i-th channel to the MIDI apparatus 9. The MIDI apparatus 9 controls the pitch bend of the sound source output note based on the pitch bend data. For example, as described above with reference to FIGS. 4 (*a*)–4 (*c*), the pitch of the sound source output note does not change from note E6 to note C6 at time t3, and the pitch of note C6 is continuously maintained. In this case, the pitch bend value data of +400 cent is added at time t3 to the note code for note C6 that is included in the note-on data for the note A that has been continuously effective since time t1.

By processes in step F408 and F409, the above-described processes in steps F402 through F407 are executed for each of the strings, and then the process returns to the main routine.

Figure 9:
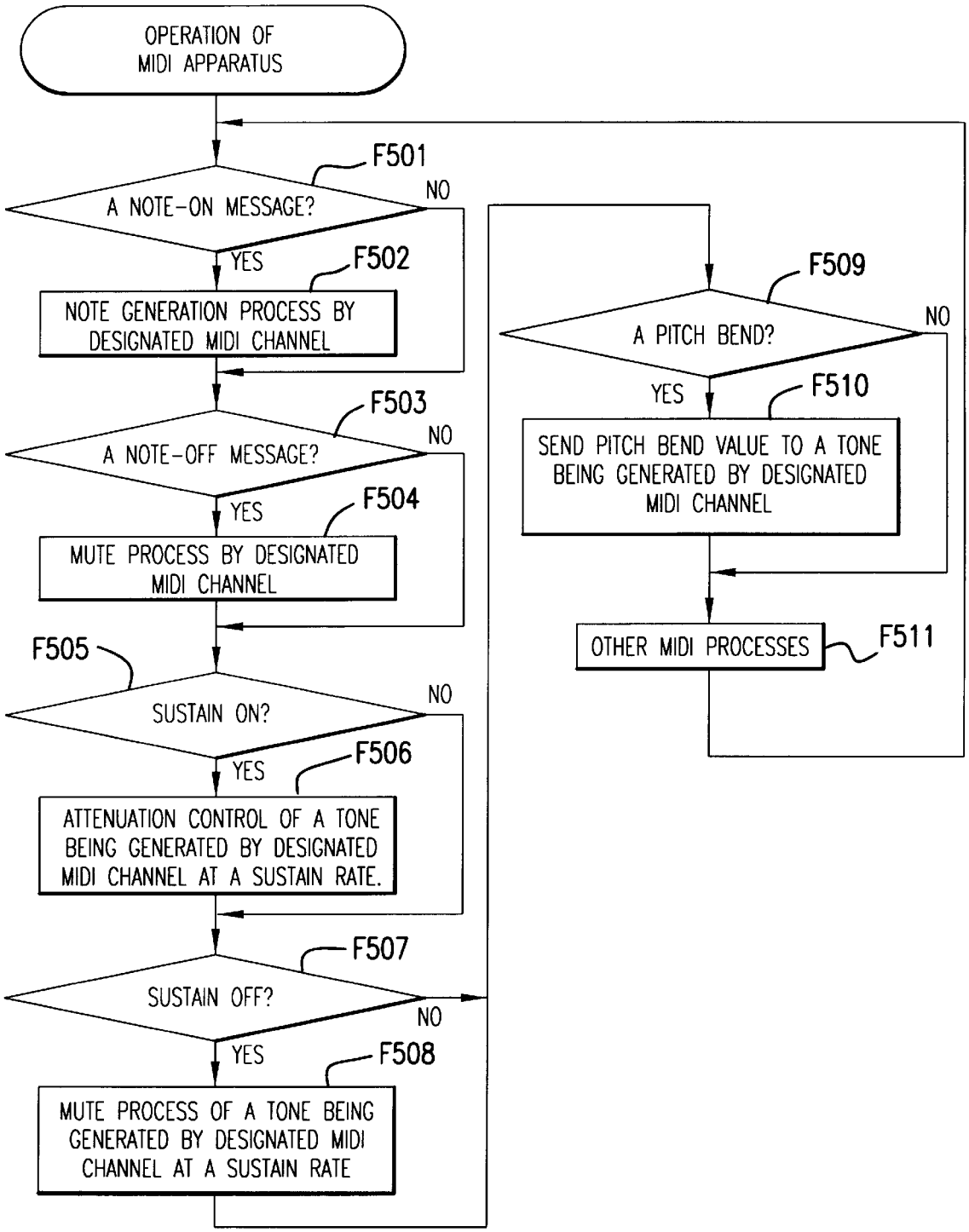
FIG. 9 shows a flow chart of a process operation of a MIDI equipment performed in response to an inputted MIDI signal.

FIG. 9 shows a flow chart of processes performed by the MIDI apparatus 9 that controls the sound source apparatus based on inputted MIDI signals. The processes are executed by, for example, a control section (not shown) that is provided in the MIDI apparatus 9.

In step F501 shown in FIG. 9, a determination is made whether a MIDI signal indicative of a note-on message is received. When a determination "no" is made, the process proceeds to step F503. When a determination "yes" is made, the process proceeds to step F502 in which a tone generation process is executed to generate a tone color by the sound source apparatus that is assigned to a MIDI channel designated by the note-on message, and then the process proceeds to step F503.

In step F503, a determination is made whether a note-off message is received. When a note-off message is not received, the process proceeds to step F505. When a note-off message is received, the process proceeds to step F504 in which a tone muting process is executed to mute a tone color generated by the sound source apparatus that is assigned to a MIDI channel designated by the note-off message.

In step F505, a determination is made whether a sustain-on message is received. When a sustain-on message is not received, the process proceeds to step F507. When a sustain-on message is received, the process proceeds to step F506 in which an attenuation process is executed to attenuate, at a predetermined sustain rate, a tone color generated by the sound source apparatus that is assigned to a MIDI channel designated by the sustain-on message.

In step F507, a determination is made whether a sustain-off message is received. When a sustain-off message is not received, the process proceeds to step F509. When a sustain-off message is received, the process proceeds to step F508 in which a mute process is executed to mute a tone color generated by the sound source apparatus that is assigned to a MIDI channel designated by the sustain-off message. At this time, the tone color is muted at a predetermined release rate, as described above with reference to FIGS. 3 (*a*) and 3 (*b*).

In step F509, a determination is made based on a MIDI signal indicative of pitch bend data whether a change in the pitch bend value is present. When a change in the pitch bend value is present, the process proceeds to step F510 in which a new pitch bend value is added to a pitch bend value of a tone color that is generated by the corresponding MIDI channel. When a change in the pitch bend value is not present, the process proceeds to step F511.

In step F511, a variety of processes corresponding to various types of message data other than the above-described note-on message, note-off message, sustain-on message, sustain-off message and pitch bend data are executed. The description of the processes executed in step F511 is omitted for the simplicity.

It is noted that the operation processes executed by the MIDI apparatus 9 shown in FIG. 9 can be executed by an ordinary MIDI apparatus. In other words, in accordance with embodiments of the present invention, the sustain and bend control mode is realized by executing the above-described processes on MIDI signals. However, the MIDI apparatus 9 itself does not require a special modification to process MIDI signals that are provided by the guitar synthesizer in accordance with an embodiment of the present invention, and an ordinary MIDI sound source apparatus can be used as the MIDI apparatus 9 that is built in the guitar synthesizer. This is advantageous in terms of reducing manufacturing costs.

In an alternative embodiment, an external MIDI apparatus can also be used to perform the sustain and bend control mode in accordance with an embodiment of the present invention.

In accordance with embodiments of the present invention, the hold and bend control mode is also implemented together with or independently of the sustain and bend control mode.

In the hold and bend control mode, a sound source output note with which a hold effect is effective is sustained according to a predetermined envelope as long as the hold and bend control mode is turned on. This provides an acoustic effect different from the acoustic effect obtained by the sustain mode in which a sound source output note is attenuated at a predetermined sustain rate. However, a pitch control can be continuously performed on a sound source output note that is held.

The guitar synthesizer generates MIDI signals required to achieve the hold and bend control mode by operation processes that are similar to those executed to achieve the above-described sustain and bend control mode.

More specifically, in the case of the hold and bend control mode, the hold and bend control mode is set on or off by a pedal-on event or a pedal-off event that may be performed in the panel process (step F102) in the main routine shown in FIG. 5. Then, the note event process, the pedal process and the pitch bend process shown in FIGS. 6 through 8 are executed.

As described above, in the sustain and bend control mode and the hold and bend control mode, MIDI signals for note-on data and note-off data are invalidated and not outputted to the MIDI apparatus 9. However, other signals are effective and outputted to the MIDI apparatus 9. Therefore, even in the sustain and bend control mode or in the hold and bend control mode, the operation keys at the panel section 7 are operated to perform a variety of controls on sound source output notes. For example, these controls include a panning control for controlling left and right sound localization, a loudness control using a loudness control pedal, a parameter variable control for controlling parameters of the built-in effectors. Also, two or more of the controls may be combined to perform a variety of acoustic effects.

Further, when one of the strings is played in the sustain and bend control mode or the hold and bend control mode in accordance with embodiments of the present invention, and the sustain effect or the hold effect is not effective on a sound source output note associated with the one of the strings, note-on data and note-off data provided by the one of the strings are still valid and the normal performance can be performed. This is achieved by the processes in steps F205 and F207 and the processes in steps F213 and F214 shown in FIG. 6. As a result, in one embodiment, while a note is played on one of the strings and a sound source output note corresponding to the note is sustained in either of the sustain effect or the hold effect, a certain phrase may be played with the other of the strings to create a multiple-performance effect. Accordingly, special effects other than those achieved by the performance method shown in FIGS. 3 (*a*) and 3 (*b*) are generated.

In accordance with embodiments of the present invention, the pitch control is continuously performed on sound source output notes with which the sustain effect (or the holding effect) is added. As a result, the present invention provides performers with performance methods and acoustic effects that cannot be achieved by the conventional sustain mode or hold mode. Furthermore, the above-described effects are achieved by processing performance data signals. As a result, a sound source apparatus, that outputs sound source output notes based on the performance data signals, does not require a special modification, and thus an ordinary sound source apparatus can be used. Consequently, the guitar synthesizer can be used with a wide variety of sound source apparatus, and thus the manufacturing cost for the guitar synthesizer is reduced.

Moreover, in accordance with an embodiment of the present invention, a pitch of a sound source output corresponding to a first note played on the guitar is detected upon a note-on event of the note. Pitch data is obtained by comparing the pitch of the sound source output under the sustain effect (or the holding effect) with a pitch of a second note detected upon a note-on event of the second note that occurs later in the sustain mode (or the holding mode). Then, the pitch data is added to pitch bend data for the sound source output corresponding to the first note to generate a performance data signal. As a result, a pitch of the sustained sound source output note does not return to an original pitch of the sound source output note corresponding to the first note when the second note is played. Accordingly, a pitch control that is responsive to pitch changes performed by the performer is applied to sound source output notes, and therefore the performer can better concentrate on his performance free of stress.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A performance data generation apparatus used with a stringed instrument that provides a string vibration, the performance data generation apparatus comprising:

a selection device that selects a predetermined performance operation mode;

a data generating device that generates performance data for controlling a tone generation condition based on the string vibration of the stringed instrument, the performance data including at least note-on and note-off data; and a control device, responsive to the selection device, that prohibits output of the note-on and note-off data from the performance data and allows output of performance data other than the note-on and note-off data when the predetermined performance operation mode is selected by operating the selection device.

2. A performance data generation apparatus as defined in claim 1, further comprising:

a pitch difference detection device that detects a pitch difference between a first pitch of a string vibration signal for a currently generated tone where the pitch is obtained in response to a note-on event of the tone and a second pitch of a string vibration signal for a newly generated tone where the second pitch is obtained after the predetermined operation mode is selected, wherein the control device generates pitch-bend data based on the pitch difference detected by the pitch difference detection device.

3. A performance data generation apparatus as defined in claim 2, wherein the control device adds the pitch-bend data generated based on the pitch difference to pitch data for the first pitch of the tone that is obtained upon the note-on event of the tone before the predetermined operation mode is selected.

4. A method of operating a performance data generation apparatus used with a stringed instrument that provides a string vibration, the method comprising the steps of:

generating performance data for controlling tone generation condition based on the string vibration of the stringed instrument, the performance data including at least note-on data and note-off data;

selecting a predetermined performance operation mode; and prohibiting output of the note-on and note-off data from the performance data and allowing output of performance data other than the note-on and note-off data when the predetermined performance operation mode is selected.

5. A method as defined in claim 4, further comprising the steps of:

detecting a pitch difference between a first pitch of a string vibration signal for a currently generated tone where the first pitch is obtained in response to a note-on event of the tone and a second pitch of a string vibration signal for a newly generated tone where the second pitch is obtained after the predetermined operation mode is selected; and generating pitch-bend data based on the pitch difference.

6. A method as defined in claim 5, further comprising the step of adding the pitch-bend data generated based on the pitch difference to pitch data for the first pitch of the tone that is obtained upon the note-on event of the tone before the predetermined operation mode is selected.

7. A method of operating a performance data generation apparatus used with a stringed instrument that provides a string vibration, the method comprising the steps of:

generating first performance data for a string vibration of a first tone upon a note-on event of the first tone, the first performance data including at least first pitch data for the string vibration of the first tone;

selecting a predetermined performance operation mode;

generating second performance data for a string vibration of a second tone upon a note-on event of the second tone after the predetermined performance operation mode is selected, the second performance data including at least second pitch data, second note-on data and second note-off data for the string vibration of the second tone;

prohibiting output of the second note-on data and the second note-off data from the performance data and allowing output of performance data other than the second note-on data and the second note-off data when the predetermined performance operation mode is selected; and generating a first sound source output tone based on the first performance data and the second pitch data after the predetermined performance operation mode is selected.

8. A method as defined in claim 7, further comprising the steps of:

detecting a pitch difference between the first pitch data and the second pitch data;

generating pitch-bend data based on the pitch difference; and adding the pitch-bend data to the first pitch data that is obtained before the predetermined operation mode is selected.

9. A method as defined in claim 8, further comprising the step of attenuating the first sound source output tone at a specified sustain rate after the predetermined performance operation mode is selected.

10. A machine-readable media storing instructions for causing a performance data generation apparatus used with a stringed instrument that provides a string vibration to perform a method of generating tones, the instructions comprising the steps of:

generating performance data for controlling tone generation condition based on the string vibration of the stringed instrument, the performance data including at least note-on data and note-off data;

selecting a predetermined performance operation mode; and prohibiting output of the note-on and note-off data from the performance data and allowing output of performance data other than the note-on and note-off data when the predetermined performance operation mode is selected.

11. A machine-readable media as defined in claim 10, wherein the instructions further comprise the steps of:

detecting a pitch difference between a first pitch of a string vibration signal for a currently generated tone where the pitch is obtained in response to a note-on event of the tone and a second pitch of a string vibration signal for a newly generated tone where the second pitch is obtained after the predetermined operation mode is selected; and generating pitch-bend data based on the pitch difference.

12. A machine-readable media as defined in claim 11, wherein the instructions further comprise the step of adding the pitch-bend data generated based on the pitch difference to pitch data for the first pitch of the tone that is obtained upon the note-on event of the tone before the predetermined operation mode is selected.

13. A machine-readable media storing instructions for causing a performance data generation apparatus used with a stringed instrument that provides a string vibration to perform a method of generating tones, the instructions comprising the steps of:

generating first performance data for a string vibration of a first tone upon a note-on event of the first tone, the first performance data including at least first pitch data for the string vibration of the first tone;

selecting a predetermined performance operation mode;

generating second performance data for a string vibration of a second tone upon a note-on event of the second tone after the predetermined performance operation mode is selected, the second performance data including at least second pitch data, second note-on data and second note-off data for the string vibration of the second tone;

prohibiting output of the second note-on data and the second note-off data from the performance data and allowing output of performance data other than the second note-on data and the second note-off data when the predetermined performance operation mode is selected; and generating a first sound source output tone based on the first performance data and the second pitch data after the predetermined performance operation mode is selected.

14. A machine-readable media as defined in claim 13, wherein the instructions further comprise the steps of:

detecting a pitch difference between the first pitch data and the second pitch data;

generating pitch-bend data based on the pitch difference; and adding the pitch-bend data to the first pitch data that is obtained before the predetermined operation mode is selected.

15. A machine-readable media as defined in claim 14, wherein the instructions further comprise the step of attenuating the first sound source output tone at a specified sustain rate after the predetermined performance operation mode is selected.

16. A performance data generation apparatus used with an instrument that provides an acoustic vibration, the performance data generation apparatus comprising:

a selection device that selects a predetermined performance operation mode;

a data generating device that generates performance data for controlling a tone generation condition based on the acoustic vibration of the instrument, the performance data including at least note-on and note-off data; and a control device, responsive to a selection by the selection device following the acoustic vibration, that prohibits output of the note-on and note-off data from the performance data and allows output of performance data based upon the acoustic vibration of the instrument other than note-on and note-off data upon selection of the predetermined performance operation mode by operating the selection device following the acoustic vibration.

17. A performance data generation apparatus as defined in claim 16, further comprising:

a pitch difference detection device that detects a pitch difference between a first pitch of an acoustic vibration signal for a currently generated tone where the pitch is obtained in response to a note-on event of the tone and a second pitch of an acoustic vibration signal for a newly generated tone where the second pitch is obtained after the predetermined operation mode is selected, wherein the control device generates pitch-bend data based on the pitch difference detected by the pitch difference detection device.

18. A method of operating a performance data generation apparatus used with an instrument that provides an acoustic vibration, the method comprising the steps of:

generating performance data for controlling tone generation condition based on the acoustic vibration of the instrument, the performance data including at least note-on data and note-off data;

selecting a predetermined performance operation mode; and prohibiting output of the note-on and note-off data from the performance data and allowing output of performance data based upon the acoustic vibration other than note-on and note-off data upon selection of the predetermined performance operation mode following the acoustic vibration.

19. A method as defined in claim 18, further comprising the steps of:

detecting a pitch difference between a first pitch of an acoustic vibration signal for a currently generated tone where the first pitch is obtained in response to a note-on event of the tone and a second pitch of an acoustic vibration signal for a newly generated tone where the second pitch is obtained after the predetermined operation mode is selected; and generating pitch-bend data based on the pitch difference.

20. A machine-readable media storing instructions for causing a performance data generation apparatus used with an instrument that provides an acoustic vibration to perform a method of generating tones, the instructions comprising the steps of:

generating performance data for controlling tone generation condition based on the acoustic vibration of the instrument, the performance data including at least note-on data and note-off data;

selecting a predetermined performance operation mode following the acoustic vibration; and prohibiting output of the note-on and note-off data from the performance data and allowing output of performance data based upon the acoustic vibration other than note-on and note-off data upon selection of the predetermined performance operation mode.

21. A machine-readable media as defined in claim 20, wherein the instructions further comprise the steps of:

detecting a pitch difference between a first pitch of an acoustic vibration signal for a currently generated tone where the pitch is obtained in response to a note-on event of the tone and a second pitch of an acoustic vibration signal for a newly generated tone where the second pitch is obtained after the predetermined operation mode is selected; and generating pitch-bend data based on the pitch difference.

* * * * *